US008806675B2

(12) United States Patent
Lah

(10) Patent No.: US 8,806,675 B2
(45) Date of Patent: Aug. 19, 2014

(54) COT

(71) Applicant: Jeh-Kun Lah, Seoul (KR)

(72) Inventor: Jeh-Kun Lah, Seoul (KR)

( * ) Notice: Subject to any disclaimer, the term of this patent is extended or adjusted under 35 U.S.C. 154(b) by 0 days.

(21) Appl. No.: 14/059,993

(22) Filed: Oct. 22, 2013

(65) Prior Publication Data

US 2014/0115780 A1 May 1, 2014

(30) Foreign Application Priority Data

Nov. 1, 2012 (KR) ..... 10-2012-0122960

(51) Int. Cl.
*A47C 17/64* (2006.01)
*A47C 19/12* (2006.01)
*A47C 19/00* (2006.01)

(52) U.S. Cl.
CPC ..... *A47C 19/12* (2013.01); *A47C 19/00* (2013.01); *A47C 17/64* (2013.01)
USPC ..... 5/111; 5/114; 5/116

(58) Field of Classification Search
USPC ..... 5/110–117
See application file for complete search history.

(56) References Cited

U.S. PATENT DOCUMENTS

| | | | | |
|---|---|---|---|---|
| 207,060 | A * | 8/1878 | de Morambert | 5/114 |
| 1,982,165 | A * | 11/1934 | Hounsfield | 5/114 |
| 2,156,507 | A * | 5/1939 | Means | 5/116 |
| 2,980,058 | A * | 4/1961 | Hoffman | 119/28.5 |
| 3,125,663 | A * | 3/1964 | Hoffman | 219/217 |
| 3,134,987 | A * | 6/1964 | Bertram | 5/111 |
| 4,219,896 | A * | 9/1980 | Behel | 5/114 |

FOREIGN PATENT DOCUMENTS

| | | |
|---|---|---|
| BE | 485 973 | 11/1948 |
| EP | 1 989 965 A1 | 11/2008 |
| FR | 750 628 | 8/1933 |
| KR | 20-1991-0017743 | 11/1991 |
| KR | 20-1995-0002825 | 4/1995 |
| KR | 20-1998-0006457 | 4/1998 |
| KR | 20-0450890 | 11/2010 |
| KR | 20-0252214 | 11/2011 |
| KR | 101289922 | 7/2013 |

OTHER PUBLICATIONS

Extended European Search Report, European Patent Application No. 13188835.6, mailed Jan. 21, 2014.

* cited by examiner

*Primary Examiner* — Robert G Santos
(74) *Attorney, Agent, or Firm* — Nixon Peabody LLP; Jeffrey L. Costellia

(57) ABSTRACT

A cot having a simple structure and capable of being easily installed and dissembled is provided. The cot includes a cloth having horizontal poles inserted into both ends thereof, a plurality of support bars for supporting a load in contact with the ground, and a plurality of connection bars connected to both ends of each support bar and respectively having clips at terminals thereof to receive the horizontal poles, wherein the clips are open toward the outside.

7 Claims, 9 Drawing Sheets

COT

CROSS-REFERENCE TO RELATED APPLICATION

This application claims priority to Korean Patent Application No. 10-2012-122960, filed on Nov. 1, 2012, and all the benefits accruing therefrom under 35 U.S.C. §119, the contents of which in its entirety are herein incorporated by reference.

BACKGROUND

1. Field

The present invention relates to a cot, and more particularly, to a cot having a simple structure and capable of being easily installed and dissemble.

2. Description of the Related Art

A cot is manufactured to be dissembled when not in use to reduce its volume so that a space occupied by the cot may decrease.

FIG. 1 is a perspective view showing a general cot.

Referring to FIG. 1, the cot has legs 50 designed to have an X shape, and connection rods 30 inserted into both ends of a seat 40 are coupled to a guide 20*a* of a support 10 to maintain an unfolded shape.

Such a cot structure is disclosed in Korean Utility Model Application Publication No. 20-1998-0006457 (SAGONG, Chul Ho), Korean Utility Model Publication No. 20-0450890 (HWANG, Ho Beum) and Korean Utility Model Publication No. 20-0252214 (PARK, Jae Hee).

Since the general cot has the legs 50 in an X shape, even though the cot is dissembled and folded, there is a limit in reducing the volume due to the great length of the legs 50. In addition, in order to maintain stability of the legs 50 with a long length, the legs 50 should have a great thickness or be made of material with great stiffness, which has a drawback in reduction of production costs or weight. In addition, when assembling the cot, a user should pull the connection rods 30 to both sides and insert into the guide 20*a* in order to spread the seat 40 tight, which however demands much force.

SUMMARY

The present invention is directed to providing a cot having a simple structure, which may reduce a weight.

The present invention is also directed to providing a cot which may be easily installed and dissembled.

In one aspect, there is provided a cot, which includes: a cloth having horizontal poles inserted into both ends thereof; a plurality of support bars for supporting a load in contact with the ground; and a plurality of connection bars connected to both ends of each support bar and respectively having clips at terminals thereof to receive the horizontal poles, wherein the clips are open toward the outside.

A clip adjusting member for pivoting the clip by a predetermined angle on a rotary shaft or fixing the clip may be coupled to at least one connection bar.

The clip adjusting member may be configured so that a length at one side extending from the rotary shaft to the clip is shorter than a length at the other side extending from the rotary shaft to an end opposite to the clip, thereby operating by means of the principle of the lever.

Each of the support bars and each of the connection bars may be integrally formed, coupled by molding, or coupled by insertion.

In case of the coupling by molding, an additional connection leg may be further coupled to a lower side of the mold.

One pair of connection bars coupled to both ends of each support bar may be coupled to have a gradually increasing interval therebetween.

The cot may further include a heating pad disposed at a lower side of the cloth.

The heating pad may be fixed to the lower side of the cloth by adhesion or detachably attached to the lower portion of the cloth by using a Velcro tape or a wire.

The cot according to the present invention may have reduced weight and volume since the support bar contacting the ground has a simple structure.

In addition, the cot according to the present invention may be conveniently assembled by a user without great effort.

Moreover, the cot according to the present invention may give warmth to a user through a heating pad.

BRIEF DESCRIPTION OF THE DRAWINGS

The above and other aspects, features and advantages of the disclosed exemplary embodiments will be more apparent from the following detailed description taken in conjunction with the accompanying drawings in which.

DETAILED DESCRIPTION

Hereinafter, a cot according to an embodiment of the present invention will be described in detail with reference to the accompanying drawings.

Figure 1:
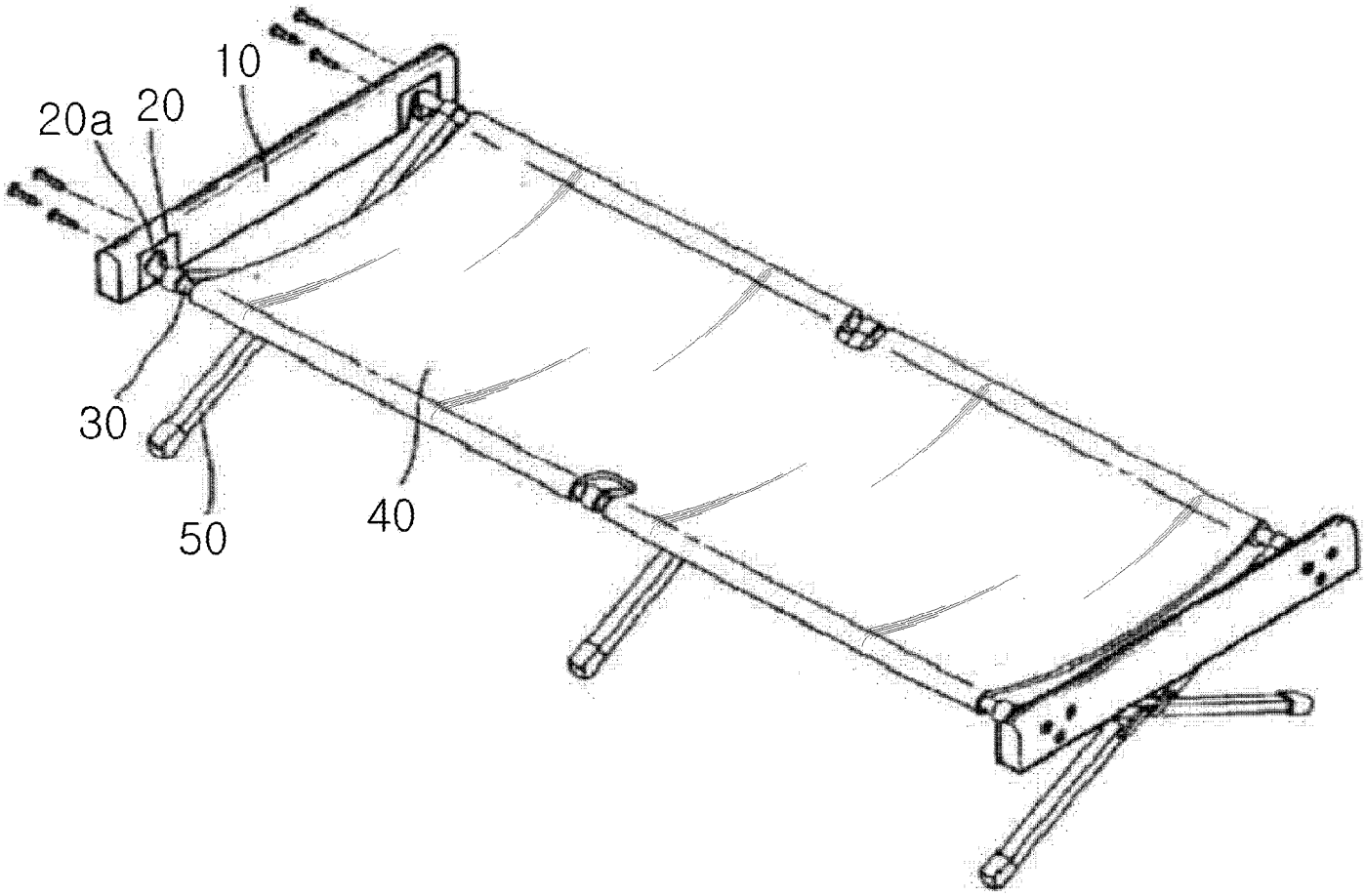
Fig. 1 PRIOR ART
FIG. 1 is a perspective view showing a general cot according to prior art.
Figure 2:
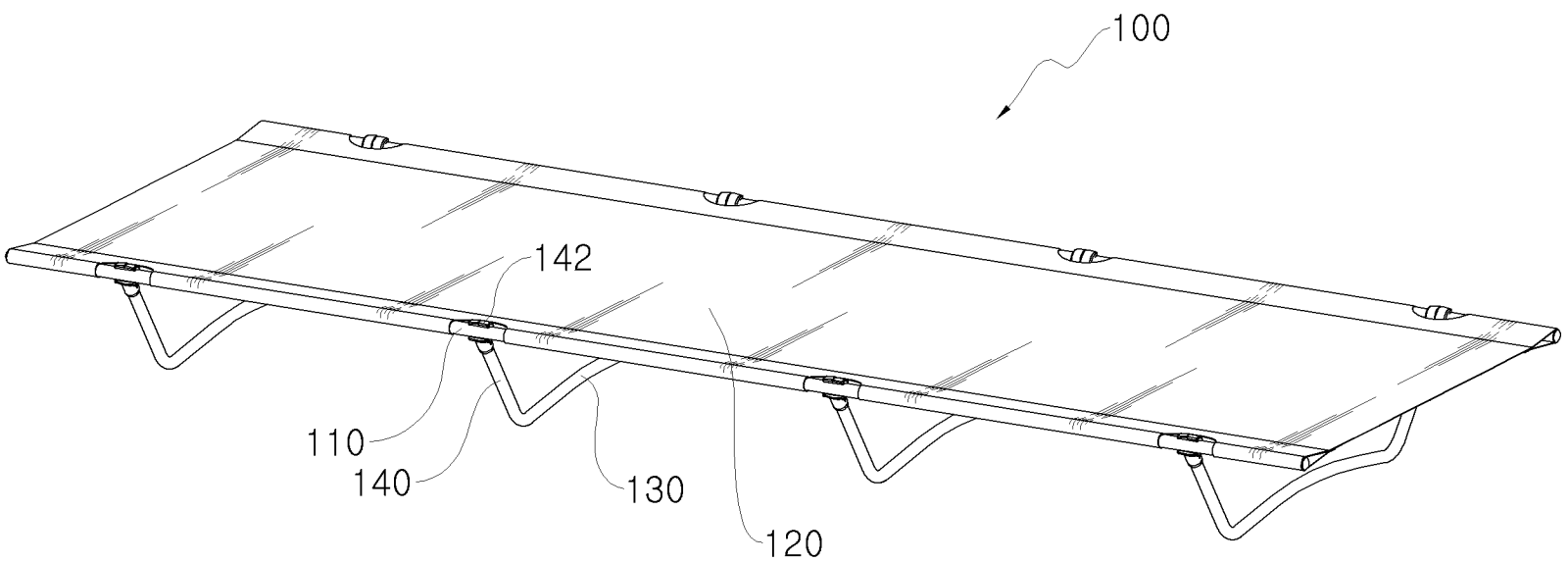
FIG. 2 is a perspective view showing a cot according to an embodiment of the present invention.

FIG. 2 is a perspective view showing a cot according to an embodiment of the present invention.

Referring to FIG. 2, the cot 100 according to the present invention includes horizontal poles 110, a cloth 120, support bars 130 and connection bars 140 respectively having clips 142 at terminals thereof.

The horizontals pole 110 are inserted into both ends of the cloth 120, and the horizontal poles 110 are coupled to the clips 142 provided at the terminals of the connection bars 140.

The support bar 130 for supporting a load in contact with the ground is connected to the lower end of the connection bar 140. Even though FIG. 2 shows four sets of the support bars 130 and the connection bars 140, the number of sets is not limited thereto but may be changed depending on various factors such as material or weight of the support bar 130 and the connection bar 140, load to be burdened, or the like.

Figure 3A:
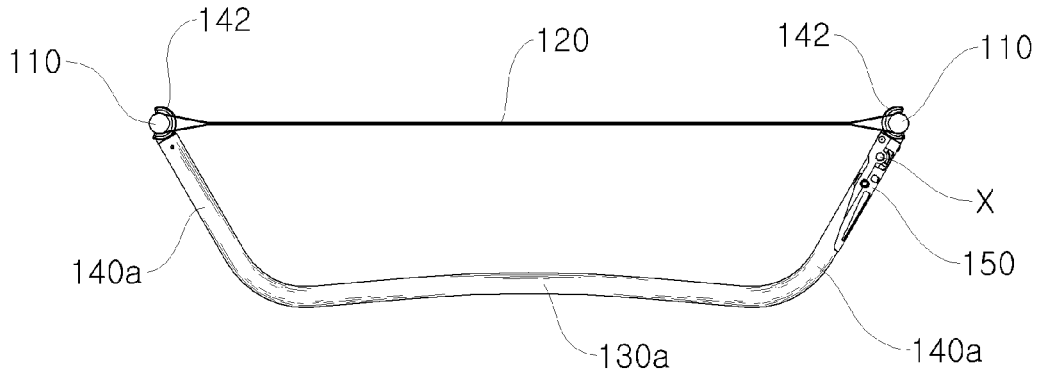
FIGS. 3A to 3C are side views showing the cot of FIG. 2.
Figure 3B:
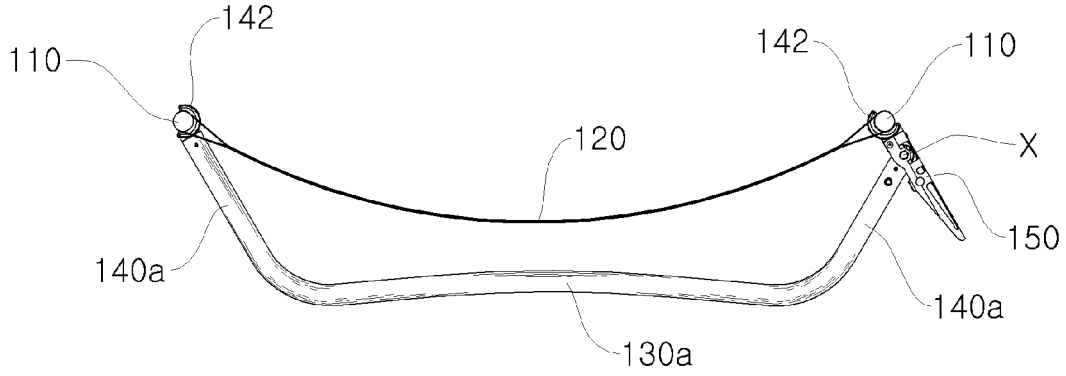
Figure 3C:
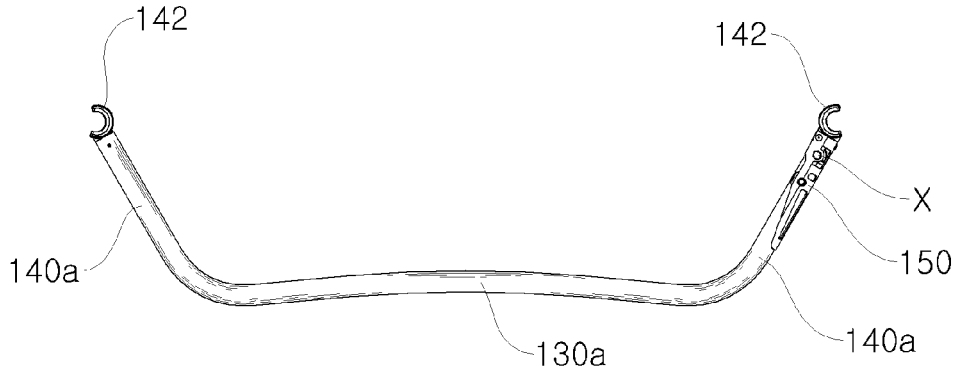

FIGS. 3A to 3C are side views showing the cot of FIG. 2.

Referring to FIGS. 3A to 3C, the support bar 130*a* and the connection bar 140*a* may be integrally formed, and the connection bars 140*a* at both ends of the support bar 130*a* may be coupled to have an interval gradually increasing upwards.

If a user lies on the cloth 120, the load of the user is transferred to the support bars 130*a* through the connection bars 140*a*, and the load is applied to the support bars 130*a* contacting the ground. In addition, if the cloth 120 is pressed downward by the load of the user, the horizontal poles 110, the clips 142 and the connection bars 140*a* at both sides are pressed to be narrowed. This force may release the coupling between the horizontal pole 110 and the clip 142. However, since the clip 142 of the present invention is formed to be open toward the outside, even though an inward force is applied to the horizontal pole 110, the coupling between the horizontal pole 110 and the clip 142 is not easily released.

In addition, the cot 100 of the present invention may include a clip adjusting member 150 installed at the connection bar 140*a* to rotate the clip 142 by a predetermined angle on a rotary shaft X or fix the clip 142. Even though it is depicted that the clip adjusting member 150 is installed only at a right side, the clip adjusting member 150 may also be installed at the connection bars 140*a* at both sides. If the clip adjusting member 150 is installed, a user may easily adjust an interval of the clips 142 at both sides by using the clip adjusting member 150, which allows easier coupling between the horizontal pole 110 and the clip 142.

Figure 4A:
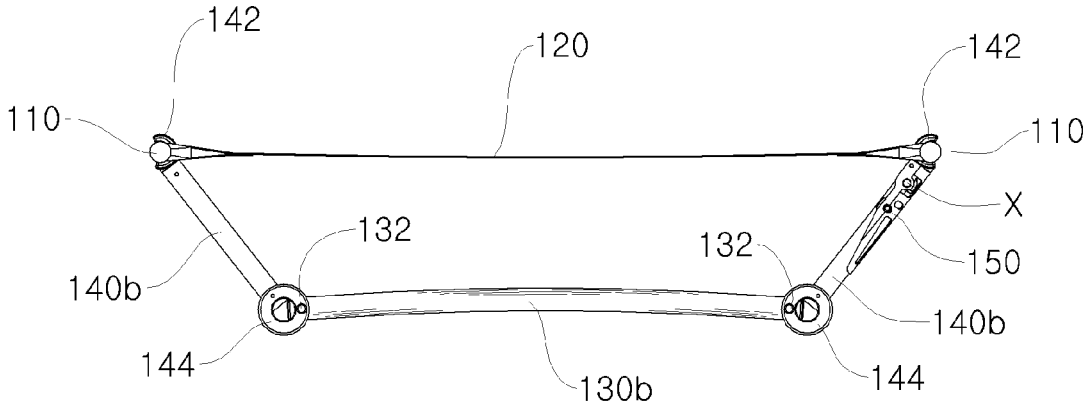
FIGS. 4A to 4C are side views showing a cot according to another embodiment of the present invention.
Figure 4B:
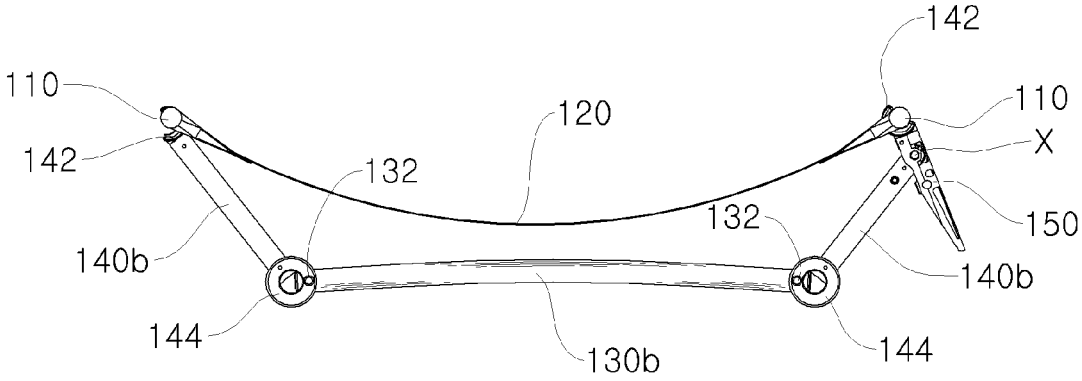
Figure 4C:
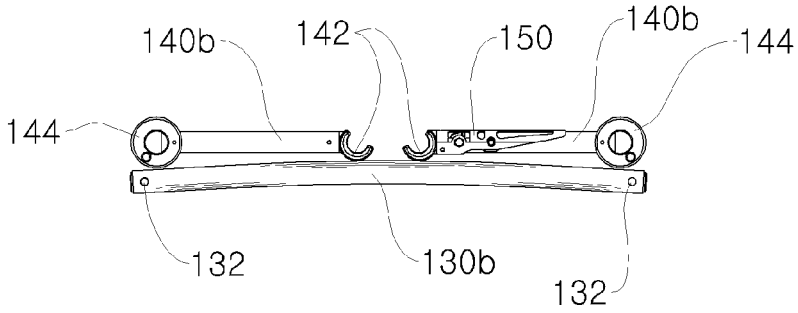
Figure 5A:
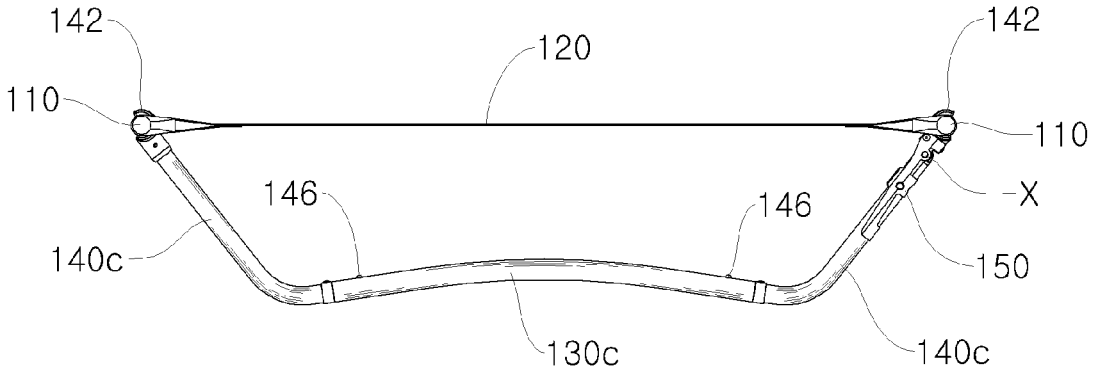
FIGS. 5A to 5C are side views showing a cot according to another embodiment of the present invention.
Figure 5B:
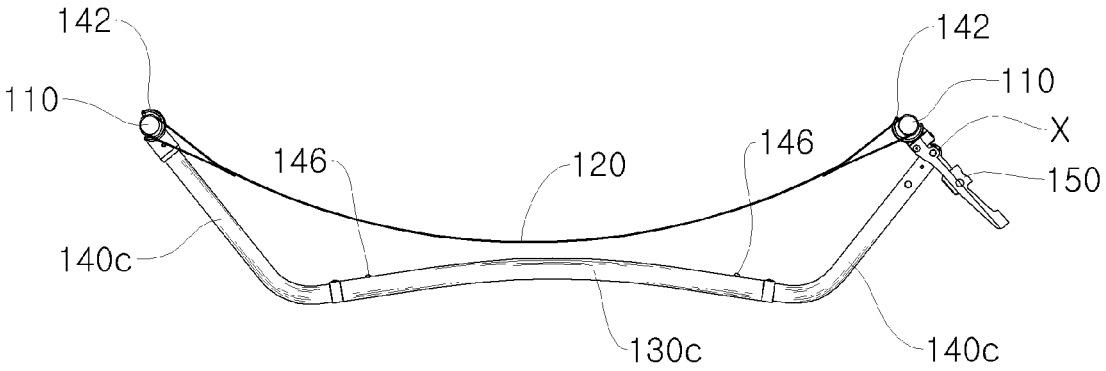
Figure 5C:
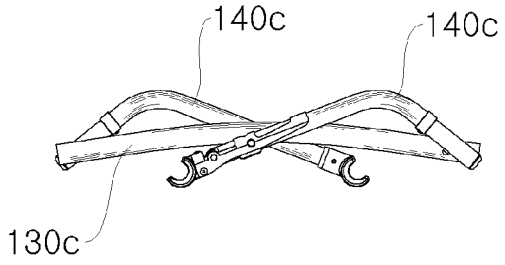

FIGS. 4A to 4C are side views showing a cot according to another embodiment of the present invention, and FIGS. 5A to 5C are side views showing a cot according to another embodiment of the present invention.

The cots shown in FIGS. 4A to 4C and FIGS. 5A to 5C are substantially identical to the cot of FIGS. 3A to 3C, except for the support bar 130 and the connection bar 140.

In FIGS. 4A to 4C, a mold 144 is disposed at a terminal of a connection bar 140*a*, and one end of a support bar 130*b* is inserted into the mold 144 and coupled thereto by molding. Here, a fixed linkage between the support bar 130*b* and the connection bar 140*a* may be maintained by a button 132 installed at a portion into which the support bar 130*b* is inserted.

In FIGS. 5A to 5C, a partial portion of the connection bar 140*c* is bent, and its terminal is inserted and into the support bar 130*c* and coupled thereto, thereby connecting the support bar 130*c* and the connection bar 140*c*. A fixed linkage between the support bar 130*c* and the connection bar 140*c* may be maintained by a button 146 installed at the insertion portion of the connection bar 140*c*.

In FIGS. 4A to 4C and FIGS. 5A to 5C, since the support bar 130*b* and the connection bar 140*a* may be separated from each other, it is possible to dissemble the cot and reduce its volume, which allows the cot to be carried more easily.

Figure 6:
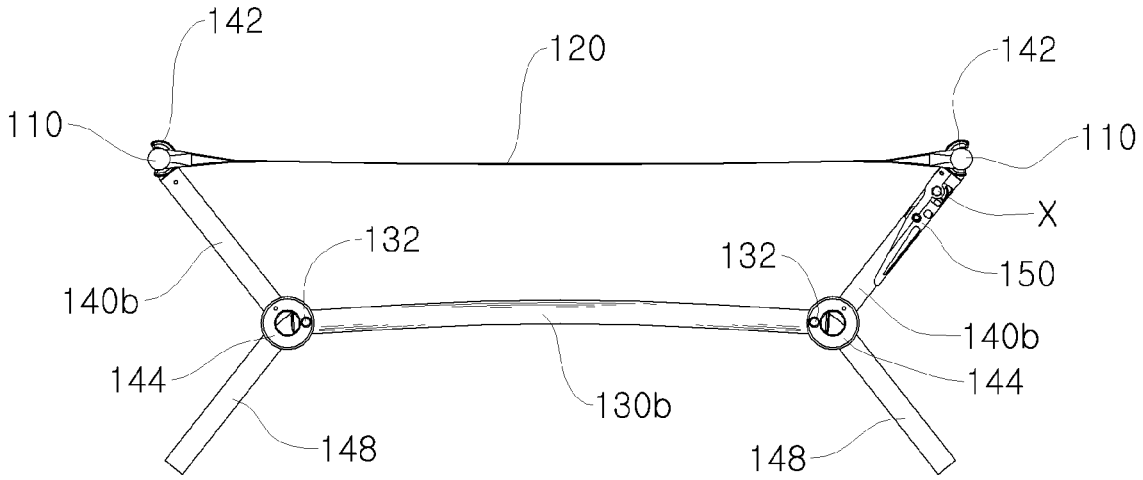
FIG. 6 is a side view showing a cot according to another embodiment of the present invention.

FIG. 6 is a side view showing a cot according to another embodiment of the present invention.

Referring to FIG. 6, an additional connection leg 148 is further coupled to the cot 100 of FIGS. 4A to 4C. In other words, in case of the coupling by molding, the additional connection leg 148 may be attached to a lower side of the mold 144, which raises the support bar 130*b* higher and thus increases the height of the cot 100. The additional connection leg 148 may be configured to be easily folded by assembling with elastic band (rubber band).

FIGS. 7A to 7D are diagrams for illustrating a process of assembling the cot of the present invention.

Figure 7A:
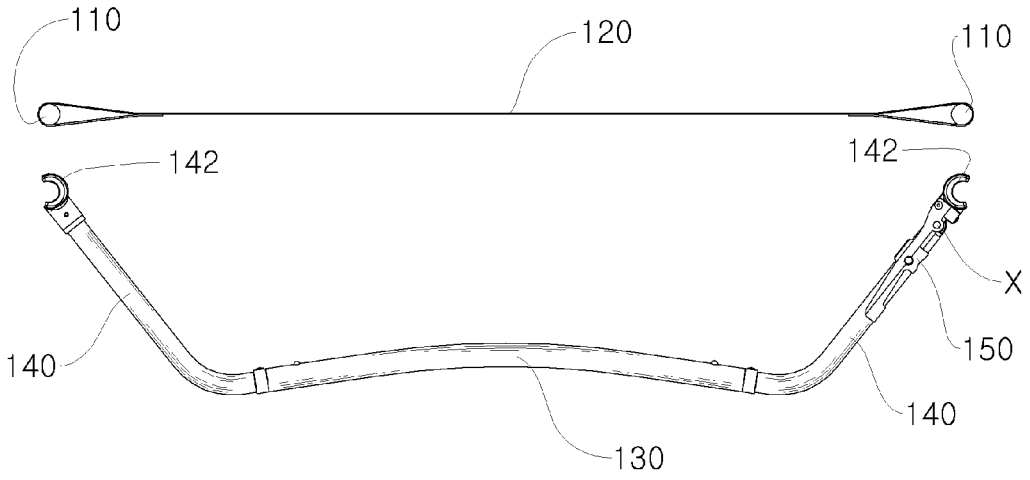
FIGS. 7A to 7D are diagrams for illustrating a process of assembling the cot of the present invention.
Figure 7B:
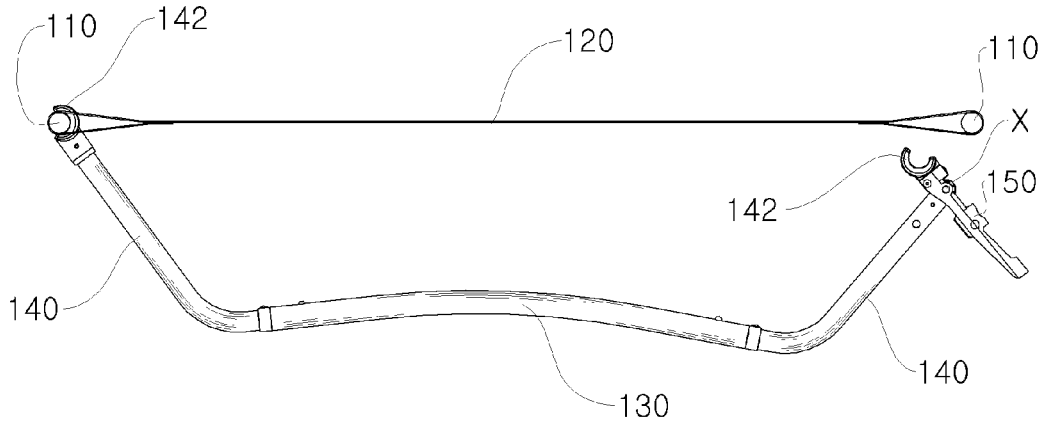

In FIG. 7A, first, the horizontal pole 110 is inserted into the cloth 120, and in FIG. 7*b*, the horizontal pole 110 is coupled to the clips 142 at one side. In addition, the clips 142 at the other side are pivoted inwards by a predetermined angle by means of the clip adjusting member 150.

Subsequently, in FIG. 7C, the horizontal pole 110 at the other side is inserted into the clips 142 pivoted inwards. As described above, in the present invention, a user may easily adjust an interval between the clips 142 at both sides by means of the clip adjusting member 150, and thus the horizontal pole 110 and the clip 142 may be coupled more easily. Here, the clip adjusting member 150 is configured so that a length Y at one side extending from the rotary shaft X to the clip 142 is shorter than a length Z at the other side extending from the rotary shaft X to an end opposite to the clip 142, which allows the clip adjusting member 150 to operate according to the principle of the lever. Since the portion of the clip adjusting member 150 to which the user applies a force from the rotary shaft X is longer than the length from the rotary shaft X to the clip 142 within an allowable range, the user may apply pretension to the cloth 120 without great efforts. In addition, due to the structure of the clip adjusting member 150, the clip 142 may move a significantly long distance. Moreover, since the support bar 130 and the connection bar 140 are made of elastic body, even though the cloth 120 droops a little due to a long-time use of the cot 100, the tension may be maintained.

Figure 7C:
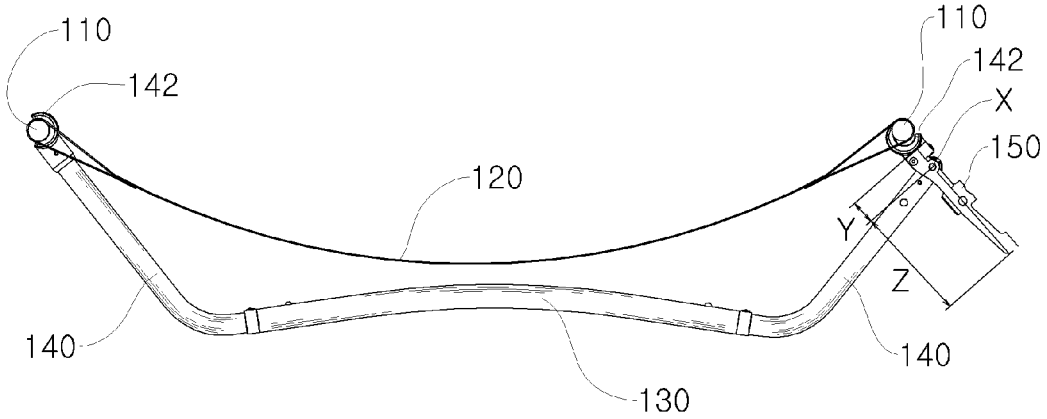
Figure 7D:
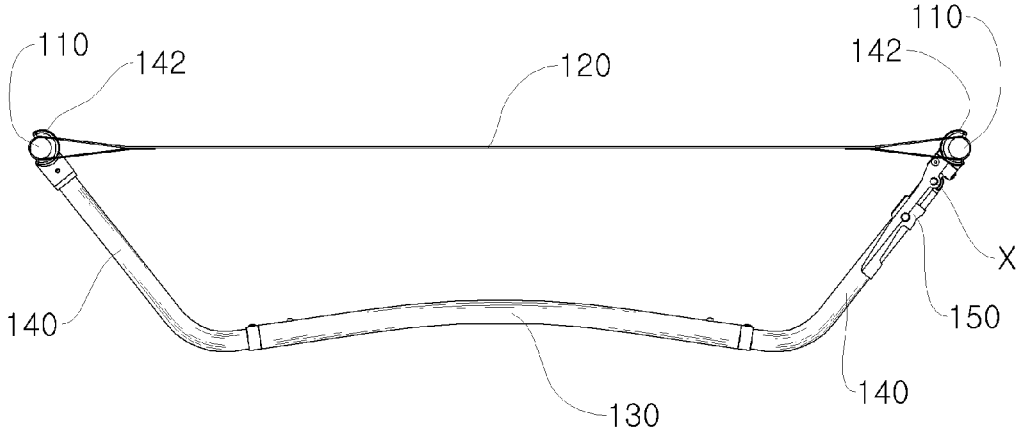

Subsequently, after the horizontal pole 110 and the clip 142 are coupled as shown in FIG. 7C, the clip 142 is pivoted again in an outward direction by means of the clip adjusting member 150 as shown in FIG. 7D to fix the clip 142, thereby completely assembling the cot 100.

Figure 8A:
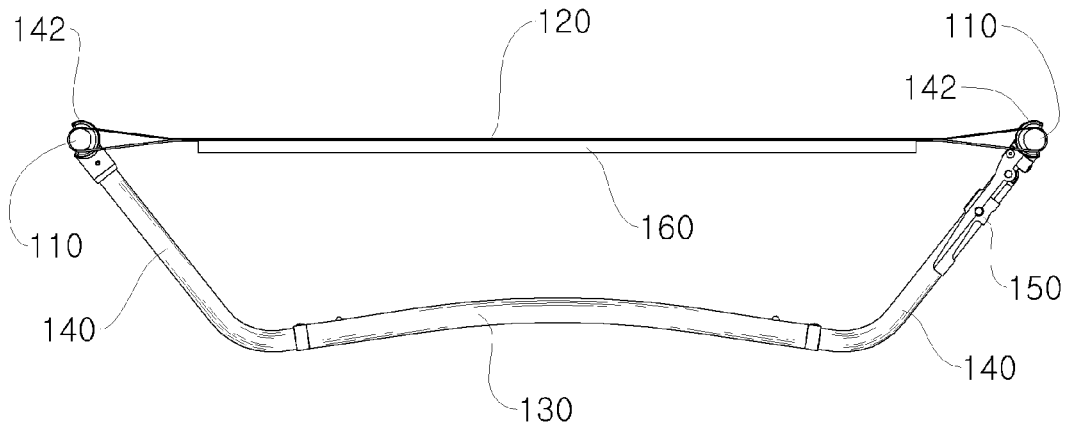
FIGS. 8A and 8B are side views a cot according to another embodiment of the present invention.
Figure 8B:
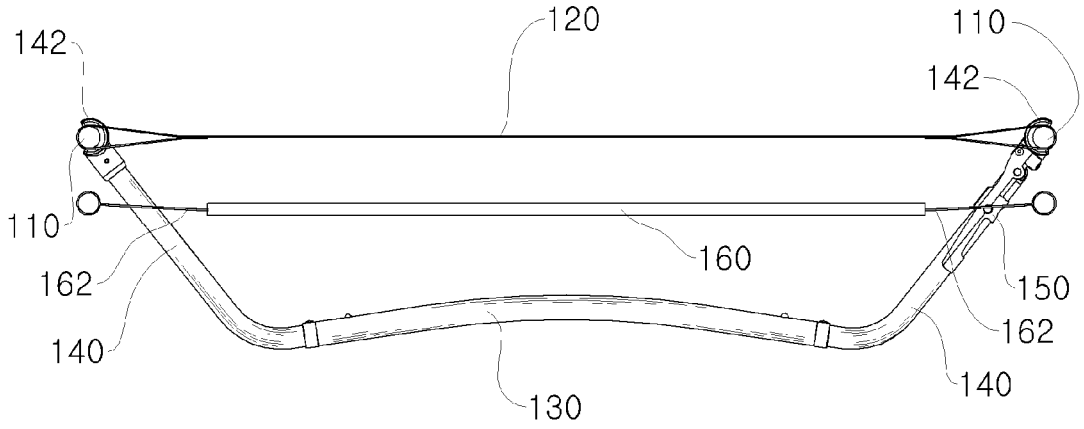

FIGS. 8A and 8B are side views a cot according to another embodiment of the present invention.

Referring to FIG. 8A, a heating pad 160 is disposed at a lower side of the cloth 120. In case of a general sleeping bag, a cloth is mostly filled with feathers to increase the volume in order to keep warmth. However, this sleeping bag may not give a sufficient warming effect if the feathers at a bottom portion are pressed due to the body of a user, and an air mattress or the like is spread on the bottom and used together with the sleeping bag in order to supplement this. However, the cot 100 of the present invention has the heating pad 160 disposed at the lower side of the cloth 120. Since the warming effect of the heating pad 160 is not influenced even though a user lies on the cloth 120, a sufficient warming effect may be provided even though the heating pad 160 has a thin design.

The heating pad 160 may be fixed to the lower side of the cloth 120 by adhering or detachably attached thereto by a hook and loop type fastener, such as the one sold under the Trademark of Velcro. In the case the cot 100 is installed at a cold place or at the outdoors, the heating pad 160 will be very useful.

FIG. 8B shows that the cloth 120 and the heating pad 160 are prepared as separate members, and the heating pad 160 is detachably attached to the lower side of the cloth 120 by using a wire 162.

If the heating pad 160 is detachably attached, it is possible to easily separate or exchange only the heating pad 160, which enhance the convenience in use.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A cot, comprising:

a cloth having horizontal poles inserted into both ends thereof;

a plurality of support bars for supporting a load in contact with the ground; and a plurality of connection bars connected to both ends of each support bar and respectively having clips at terminals thereof to receive the horizontal poles, wherein the clips are open toward the outside, and wherein a clip adjusting member is coupled to the terminal of at least one of the plurality of connection bars to pivot on a rotary shaft, and the clip is disposed at one side of the clip adjusting member so that the clip adjusting member is formed to pivot the clip at a predetermined angle or to fix the clip.

2. The cot according to claim 1, wherein the clip adjusting member is configured so that a length at one side extending from the rotary shaft to the clip is shorter than a length at the other side extending from the rotary shaft to an end opposite to the clip, thereby operating by means of the lever principle.

3. The cot according to claim 1, wherein each of the support bars and each of the connection bars are integrally formed, coupled by molding, or coupled by insertion.

4. The cot according to claim 3, wherein in case of the coupling by molding, an additional connection leg is further coupled to a lower side of the mold.

5. The cot according to claim 3, wherein one pair of connection bars coupled to both ends of each support bar are coupled to have a gradually increasing interval therebetween.

6. The cot according to claim 1, further comprising a heating pad disposed at a lower side of the cloth.

7. The cot according to claim 6, wherein the heating pad is fixed to the lower side of the cloth by adhesion or detachably attached to the lower portion of the cloth by using a Velcro tape hook and loop type fastener or a wire.

* * * * *